United States Patent [19]

Pohl-Michel

[11] Patent Number: 4,458,962

[45] Date of Patent: Jul. 10, 1984

[54] REFUSE BINS

[76] Inventor: Erika Pohl-Michel, Im Erlich 56, D-6100 Darmstadt-Arheilgen, Fed. Rep. of Germany

[21] Appl. No.: 364,597

[22] Filed: Apr. 2, 1982

[30] Foreign Application Priority Data

Apr. 4, 1981 [DE] Fed. Rep. of Germany ..... 3113704

[51] Int. Cl.[3] ..... B65F 1/02

[52] U.S. Cl. ..... 312/211; 312/290

[58] Field of Search ..... 232/26, 47, 49, 50, 232/51, 58; 248/99, 100; 220/1 T, 403, 404; 312/217, 283, 290

[56] References Cited

U.S. PATENT DOCUMENTS

| | | | |
|---|---|---|---|
| 2,903,215 | 9/1959 | Metcalf | 248/99 |
| 3,836,637 | 9/1974 | Bass | 220/1 T |
| 4,027,774 | 6/1977 | Cote | 220/1 T |
| 4,106,734 | 8/1978 | Walitalo | 248/100 |
| 4,175,602 | 11/1979 | Cavalaris et al. | 248/99 |
| 4,363,417 | 12/1982 | Rhoades et al. | 220/1 T |

*Primary Examiner*—Francis K. Zugel

*Assistant Examiner*—Joseph Falk

*Attorney, Agent, or Firm*—James Creighton Wray

[57] ABSTRACT

A bin for collecting refuse or garbage, for example womens' sanitary towels or napkins, comprises a tall narrow container which is open at the top and closed by a removable cover which has a substantially horizontal top surface. Disposed on the front of the bin, just below the cover, is an insertion opening having a closure flap which can be selectively opened and closed. Disposed in the interior of the bin is a bag for receiving inserted refuse or garbage. The closure flap has a shield means which projects into the interior of the bin and which covers an upper edge of the bag suspended in the bin, in the region of the insertion opening, so that refuse or garbage which is put into the bin can pass into the bag and not between the bag and the adjacent wall of the bin. The bag has suspension means at the sides thereof by means of which it can be suspended from carrying handles which project from the sides of the bin. Desirably, the bag is impregnated with or contains a deodorant and/or disinfectant substance.

17 Claims, 6 Drawing Figures

REFUSE BINS

BACKGROUND OF INVENTION

German Utility Model No. 7 930 475 discloses a refuse bin or container which is of tall narrow form and has an insertion flap. The plan outline of this known bin, which is convex all around, is inscribed in a rectangle with a predetermined ratio between the sides, and the sides are connected by portions which are of an arcuated configuration. An insertion opening is arranged on the top and is closable by means of a double flap. A germicidal disinfection fluid is disposed in the bin.

SUMMARY OF INVENTION

This invention relates to refuse bins, for example for womens' sanitary towels or napkins and the like.

According to the present invention there is provided a refuse bin comprising

- a tall narrow container having an insertion opening in a side wall thereof,
- means enabling a bag to be removably suspended in the bin,
- a closure flap which is pivotally mounted at its lower end about a horizontal axis to said side wall of the bin to enable the insertion opening to be selectively opened and closed, the closure flap having a side shield portion adjoining each of two sides of the insertion opening, and the closure flap also having a shield means which projects into the interior of a bag suspended, in use, in the bin, which shield means is in the form of an extension portion and is of such a configuration that refuse inserted through the insertion opening is certain to pass into the interior of the bag suspended in the bin, and
- a removable cover which is formed as a storage surface and which normally covers an opening provided at the top of the bin for removal of the bag.

A preferred form of refuse or trash bin embodying the invention and described hereinbelow can be maintained and kept clean more easily than the known bin described above. The preferred bin has the great advantage, from the point of view of maintenance of the bin, that a bag for accommodating the refuse, garbage or trash can be removed, for example by cleaning personnel, when required, that is to say when the bag is fairly full, and can easily be replaced by a fresh, empty bag. In contrast, the known bins, which are filled with disinfecting fluid and which are comparatively large, usually have to be removed by means of a lorry or truck in accordance with a predetermined rota and replaced by fresh, empty bins. The collection rota is generally fixed, but the amount of refuse or garbage thrown into the bin may vary widely from one particular period to another. There is therefore a danger of the above-mentioned known bins either becoming overfull or being changed when they are almost empty, which involves unnecessary work and expense.

A substantial advantage with regard to handling the bins and the bags can be achieved if the bin is provided with projections at two side walls which adjoin the side wall which is provided with the flap, and extension portions of the bag which extend outwardly over the upper edges of the respective side walls of the bin are engaged with the projections.

By virtue of this arrangement, it is possible in a very simple manner and without a substantial increase in cost for the bag which is suspended in the bin or the lateral extension portions thereof to be taken outwardly over the upper edges of the two side walls of the bin and downwardly to the above-mentioned projections, so that the bag or the extension portions can be engaged with the projections.

Other objects and advantages of the present invention will become apparent from a study of the following description and the accompanying diagrammatically simplified drawings which are merely illustrative of the present invention. In the drawings corresponding components are denoted by the same reference numerals throughout.

DESCRIPTION OF PREFERRED EMBODIMENTS

Figure 5:
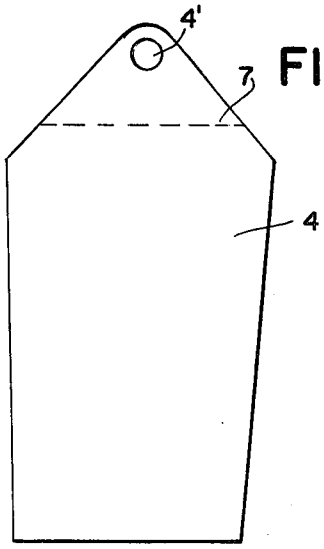
FIG. 5 is a side view of a form of bag which can be suspended in the bottom portion of the bin.

The illustrated refuse or garbage bin comprises a bottom housing portion 1, a top housing portion 2 which is in the form of a removable cover or lid, and a closure flap 3 which is pivotally mounted to a substantially vertical front wall of the bottom portion 1. A bag 4 is disposed in the interior of the bottom portion 1 and is engaged by means of a suspension arrangement 5 on projections 6 which are formed on the sides of the bottom housing portion 1 to act as carrying handles. The suspension arrangement may be of a different configuration. For example, two extension portions in the form of strips or bands, connected by a web or limb portion, may be secured to the upper edge of the two side walls of the bag, the strips being taken over the upper edge of the bottom housing portion 1 and the web portion which interconnects the two strips being engaged on the underside of the two projections 6. Alternatively, however, as shown in FIG. 5, the two oppositely disposed side walls may be of suitable increased length and may then be taken over the upper edge of the bottom housing portion 1, and engaged into the projections 6, by means of an opening 4' at each side thereof. In FIG. 5, a broken line 7 indicates the position at which the side wall of the bag 4 is laid over the upper edge of the corresponding side wall of the bin bottom portion 1.

Figure 6:
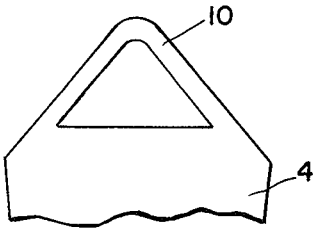
FIG. 6 is a side view of the top portion of another form of a bag wherein the extension portions are of strip-like configuration.

In some cases it is advantageous if the top portion of a bag is modified and provided on two opposite sides with strips 10 as illustrated in FIG. 6.

Figure 1:
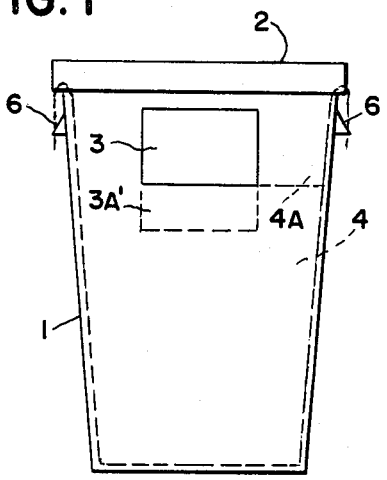
FIG. 1 is a front view of a refuse bin constituting a preferred embodiment of the invention.
Figure 2:
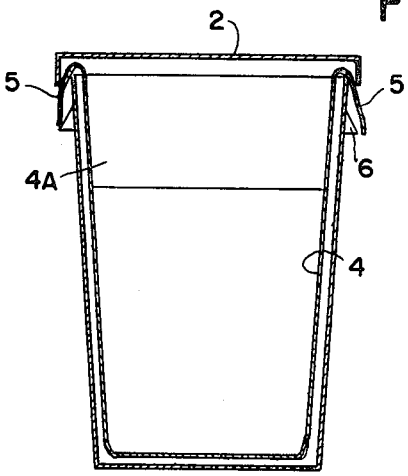
FIG. 2 is a front view in longitudinal section through the bin shown in FIG. 1, with a bag suspended therein.
Figure 3:
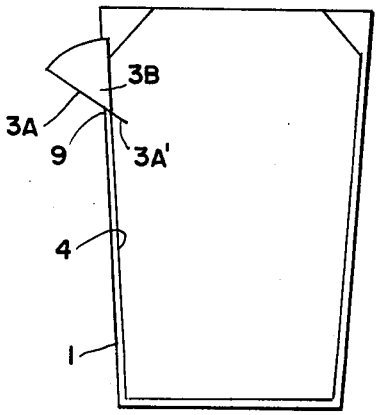
FIG. 3 is a side view of the bin shown in FIG. 1, in section through the bottom portion, perpendicularly to the section shown in FIG. 2, with a movable closure flap thereof in an open condition.
Figure 4:
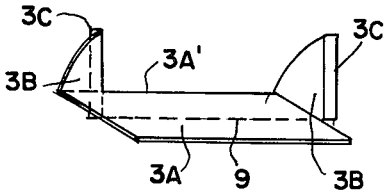
FIG. 4 shows structural details of the movable closure flap which can be seen in FIGS. 1 and 3.

The closure flap 3 is pivotally mounted at its lower end to the front wall of the bottom housing portion 1 about a horizontal axis 9 (FIGS. 3 and 4). The closure flap 3 can selectively occupy a position in which it closes an insertion opening in the front wall of the bottom housing portion 1, or a position in which it opens the insertion opening to enable rubbish or garbage to be inserted into the bin. In FIG. 1, the closure flap 3 is shown in the closed position, while in FIG. 3 the flap is shown in the open position. The closure flap 3 comprises a substantially flat front plate portion 3A, two side closure plate or shield portions 3B which delimit the front plate portion 3A at the sides thereof and which are of a substantially quarter-circular configuration, and bent strip portions 3C which serve as abutment means in the open position of the flap to limit outward pivotal movement of the front plate portion 3A such that the portion 3A can be pivoted outwardly through 60°.

The flat front plate portion 3A, which is directed upwardly at an angle in the open position of the flap (see FIG. 3), has a narrow extension portion 3A' which extends into the interior of the bottom housing portion 1 and which is formed as or acts as a shield means. When the closure flap 3 is in the outwardly pivoted (open) position, the extension portion 3A' is intended to cover an upper edge for a of the bag 4, which is suspended in the bin in the position of use, in such a way that refuse which is put into the bin through the insertion opening is sure to pass into the interior of the bag suspended therein, and cannot therefore pass between the bag 4 and the adjoining wall of the bottom housing portion 1. The shield means 3A' also serves as a counter-weight for producing automatic closing of the closure flap.

The top housing portion 2 which acts as a cover or lid to close the bottom housing portion 1 at the top thereof has a surface which is substantially horizontal in the position of use, so that a person using the bin is able to put a handbag or purse or the like on the top surface of the bin, which can serve as a storage surface.

The bag 4 is desirably impregnated with a deodorant and/or disinfectant substance. It may possibly also be desirable for the bag to contain a fluid with deodorant and/or disinfectant properties, for example a hypochlorite solution with a germicidal action.

What is claimed is:

1. A trash bin comprising a tall narrow container having an insertion opening in a side wall thereof, means on said container enabling a bag to be removably suspended in the bin, a bag suspended in said bin, a closure flap which is pivotally mounted at its lower end about a horizontal axis to said side wall of the bin to enable the insertion opening to be selectively opened and closed, the closure flap having a side shield portion adjoining each of two sides of the insertion opening, and the closure flap also having a shield means which projects into the interior of said suspended bag, which hield means is in the form of a portion which extends into the interior of said container and over the bag such that refuse inserted through the insertion opening is certain to pass into the interior of the bag suspended in the bin, and a removable cover which is formed as a storage surface and which normally covers an opening provided at the top of the bin for removal of the bag.

2. A bin according to claim 1, comprising abutment means operative to limit outward pivotal movement of a front plate portion of the closure flap in such a way that the front plate portion can be pivoted outwardly through 60°.

3. A bin according to claim 2, where side walls of the closure flap have outwardly bent projections which co-operate with the inside of said side wall of the bottom housing portion to limit the pivotal movement.

4. A bin according to claim 1, wherein the cover is horizontal in the position of use.

5. A bin according to claim 1 wherein the bag is impregnated with a deodorant substance.

6. A bin according to claim 1, wherein the bag comprises at least one extension portion at a side wall which adjoins the side wall having the insertion opening, the extension portion being securable to an upper edge of the bin.

7. A bin according to claim 5, wherein the bag comprises a respective said extension portion at each of two side walls adjoining the side wall of the bin having the insertion opening.

8. A bin according to claim 7, wherein the extension portions are of a strip-like configuration.

9. A bin according to claim 7, wherein the bin has external projections on the two side walls adjoining the side wall having the insertion opening, and wherein the extension portions of the bag can be taken outwardly over the upper edge of the respective side walls of the bin and engaged on the projections.

10. A bin according to claim 9, wherein the projections are in the form of handles for lifting the bin.

11. A bin according to claim 1, the bag further comprising two upwardly extended side walls having holes in their upper region and so arranged and of such dimensions, with respect to the bin, that said extended side portions can be engaged with corresponding projections of the bin.

12. Trash bin apparatus comprising a tall narrow container having an open top and having a trash insertion opening in a side wall thereof, a removable flat cover, covering the open top of the bin, opposite projections extending outward from the bin near an upper edge thereof beneath the cover, a trash bag positioned in the bin, the trash bag having an upper edge positioned adjacent a lower edge of the trash insertion opening in the side wall of the bin and the bag extending downward from the upper edge within the bin for receiving trash inserted through the insertion opening, and the bag having opposite upward extension portions which extend upward within the bin and over an open upper edge of the bin and downward around an upper portion of the bin, the extensions having means for engaging the projections on the bin for holding the extensions and thereby supporting the bag within the bin with the upper edge of the bag positioned adjacent a lower edge of the insertion opening in the side wall of the bin, a closure flap pivotally mounted at its lower end about a horizontal axis to the side wall of the bin at a lower edge of the insertion opening to enable the insertion opening to be selectively opened and closed, the closure flap having opposite side shield portions extending from the flap inward through opposite side edges of the insertion opening, and the closure flap having a shield means projecting into the interior of the bin and over the upper edge of the bag suspended in the bin whereby refuse inserted in the bin through the insertion opening passes over the shield means and into an interior of the bag suspended in the bin.

13. The apparatus of claim 12 wherein the bag extensions have generally triangular shape with openings near outer extremities for engaging the projections.

14. The apparatus of claim 13 wherein the openings are circular.

15. The apparatus of claim 14 wherein the openings are generally triangular for forming strip-like configurations between the openings and outer edges of the projections.

16. The apparatus of claim 12 wherein the projections are in the form of handles for lifting the bin.

17. Trash bin apparatus comprising a bin having upward extending sides, a closed bottom and an open top, and an insertion opening in a side wall thereof near the top, a removable cover for closing the top, and the bin having handles projecting outward from opposite sides of the bin adjacent the top and beneath the cover, a bag positioned in the bin and extending downward to the bottom of the bin and having an upper edge positioned beneath a lower edge of the insertion opening and upward extensions on opposite sides of the bag extending upward from the open edge and over the top of the bin and downward along outer sides of the bin and over projecting handles and the extensions having openings therethrough for receiving the projecting handles whereby the bag is held suspended within the bin and whereby the bag may be removed from the bin by removing the removable cover, disengaging the holes from the handles and lifting the bag from the bin by the holes in the extensions and wherein the bin further comprises a closure flap for closing the insertion opening and pivotally mounted on a lower edge of the insertion opening, the closure flap having an inward extending shield extending inward in the bin and over the upper edge of the bag, the shield being aligned with the closure flap to ensure that all material inserted through the insertion opening passes over the shield and into an interior of the bag.

* * * * *